US005211613A

United States Patent [19]

Friesl

[11] Patent Number: 5,211,613

[45] Date of Patent: May 18, 1993

[54] EXERCISING MACHINE WITH IMPROVED ANTI-DRAFTING ENERGY ABSORBING FANWHEEL

[75] Inventor: Robert C. Friesl, Country Club Hills, Ill.

[73] Assignee: Schwinn Bicycle Company, Chicago, Ill.

[21] Appl. No.: 903,241

[22] Filed: Jun. 23, 1992

[51] Int. Cl.[5] ..... A63B 22/06; A63B 69/16

[52] U.S. Cl. ..... 482/58; 482/62; 482/63; 416/197 R; 416/243

[58] Field of Search ..... 482/63, 53, 58-59, 482/62, 57, 111, 148; 416/197 R, 243

[56] References Cited

U.S. PATENT DOCUMENTS

| | | | |
|---|---|---|---|
| 3,581,663 | 6/1971 | Lohmann | 416/243 |
| 3,979,113 | 9/1976 | Uhl et al. . | |
| 4,037,989 | 7/1977 | Huther | 416/243 |
| 4,188,030 | 2/1980 | Hooper . | |
| 4,355,958 | 10/1982 | Cornick | 416/243 |
| 4,537,396 | 8/1985 | Hooper . | |
| 4,589,656 | 5/1986 | Baldwin . | |
| 4,743,011 | 5/1988 | Coffey . | |
| 4,934,688 | 6/1990 | Lo . | |
| 4,961,570 | 10/1990 | Chang . | |
| 4,962,925 | 10/1990 | Chang . | |
| 4,971,316 | 11/1990 | Dalebout et al. | 482/59 |
| 5,000,444 | 3/1991 | Dalebout et al. . | |

*Primary Examiner*—Stephen R. Crow

*Attorney, Agent, or Firm*—McCaleb, Lucas & Brugman

[57] ABSTRACT

Exercising machine having a vaned fanwheel rotatably mounted on a frame in open air and arranged to absorb energy by rotating the vane blades against ambient air. The fanwheel comprises a hub with a plurality of air vanes which are movable in an orbit around the axis of the hub. Each vane comprises a blade having leading and trailing surfaces. In the preferred example shown, each blade is a semi-cylindrical plate mounted with the hollow, concave side comprising the leading surface, and the streamlined, convex side comprising the trailing surface. The vanes are circumferentially spaced apart to substantially eliminate drafting and stagnant wake regions between blades. The coefficient of drag for the concavo/convex vane blades of this invention are substantially twice that obtained by flat plate vane blades conventionally used. Alternative forms of the invention are illustrated with semi-spherical concavo/convex and semi-cylindrical plano/convex blades. All have in common trailing streamlined convex surfaces.

9 Claims, 7 Drawing Sheets

EXERCISING MACHINE WITH IMPROVED ANTI-DRAFTING ENERGY ABSORBING FANWHEEL

BACKGROUND OF THE INVENTION

This invention relates to exercising equipment in which the energy absorber is a vaned fanwheel rotatably mounted on the frame. This equipment takes many forms, beneficially developing and keeping in tone particular groups of muscles which are used in traditional exercising activities such as biking, rowing, swimming, cross-country skiing, and stair climbing. The work done by a group of muscles can be measured simply and accurately under controlled conditions by a speedometer connected to the fanwheel calibrated in watts, horsepower, foot pounds per minute, gram calories per minute or other suitable ergometric readouts. In this application, the invention is described for use with a cycle exerciser, but this is by way of illustration and not by way of limitation.

Exercising equipment in which the energy absorber is a vaned fanwheel is shown in Hooper U.S. Pat. No. 4,537,396 where the energy absorber is a volute fan. Applications described in that patent include a swimming machine (FIG. 1), a rowing machine (FIG. 7), a weight lifting machine (FIG. 8), leg exercising machines (FIGS. 9 and 10), and a stationary cycle machine (FIG. 11). In another Hooper U.S. Pat. No. 4,188,030, the energy absorber is a vaned fanwheel having flat blade vanes.

Daleabout U.S. Pat. Nos. 4,971,316 and 5,000,444 show fanwheel energy absorbers using conventional flat blade vanes applied to stationary cycle type exercisers. Lo U.S. Pat. No. 4,934,688 shows flat blade vanes (FIG. 8). Baldwin U.S. Pat. No. 4,589,656 shows a pair of squirrel cage fans 18*a* and 18*b* (FIGS. 6 and 7). Chang U.S. Pat. Nos. 4,961,570 and 4,962,925 show flat blade vanes applied respectively to a climber exerciser and a stationary cycle exerciser. Uhl U.S. Pat. No. 3,979,113 shows flat blade vanes in a stationary cycle exerciser. And Coffey U.S. Pat. No. 4,743,011 shows flat blade vanes applied to a rowing exercise machine.

In the air resistance exercisers shown in the above patents, and in most air resistance exercisers that are available in the retail marketplace, air resistance is obtained by a large fan-like wheel of some sort. These are generally nothing more than modified bicycle wheels or plastic molded counterparts of similar configuration. In all cases, the fanwheels are by far the largest single component of the exerciser. A drawback is that a large wheel takes a large safety guard which in turn makes the entire exerciser bigger, heavier and more expensive.

In these conventional fanwheels, the air vanes are flat plates, or as in the case of the squirrel cage rotors shown in U.S. Pat. Nos. 4,537,396 and 4,589,656, are essentially flat plates set so close together in volute casings that they are in drafting relationship and highly ineffective compared with the present invention.

With a first flat plate moving flatwise through air, a long wake is produced behind the plate. When a second flat plate is positioned within the wake of the first, it is in a stagnant air region or a partial vacuum and is said to be in "drafting" relation with the first plate and the effectiveness of the fan as an energy absorber is greatly diminished.

Thus, in conventional air vane energy absorbers, there is considerable room for improvement in reducing the size of the fan wheel and increasing its energy absorbing efficiency.

SUMMARY OF THE INVENTION

Air resistance of a vane moving in open air, that is, not restrained by a volute or other casing, is determined mainly by two factors, namely, the drag coefficient $C_D$ related to the skin friction drag, and the shape which determines the volume of air moved by the vane.

The drag coefficient $C_D$ is a force component applied by air against an object moving in it, or vice versa. It is determined by the geometry of the object, and is not limited to the frontal area. For example, a flat rectangular blade oriented at right angles to its direction of movement in air will have a drag coefficient of 1.20, whereas for a hollow concavo-convex semi-cylinder having the same frontal area, $C_D$ will be 2.30, almost twice as great. These coefficients of drag are well known and listed in standard engineering publications for many different shaped standard objects.

Skin friction is an important component of the coefficient of drag. A convex, streamlined trailing surface and a hollow concave leading surface to which converging air streams cling increase the drag by skin friction.

Where the leading surface of the blade is concave, for example, a hollow concave semi-cylinder, this shape will move a larger volume of air than if it were flat. Inasmuch as it takes more power to move more air, there will therefor be more resistance to moving the blade.

It is a general object of the present invention to provide in an exercising machine an energy-absorbing fanwheel having air vane blades with drag coefficients substantially greater than the flat or nearly flat air vane blades conventionally used.

Another object of the invention is to provide the air vane blades with streamlined convex trailing surfaces each having rearwardly converging side surface portions effective to direct opposite converging air streams along those side surface portions and to merge them into a relatively higher pressure central stream directed toward the immediately following blade to thereby maximize skin friction of the air against the blade and minimize drafting between blades.

Another object is to provide such a fanwheel in which the air vane blades are shaped to maximize the coefficient of drag while minimizing or eliminating drafting between vanes, thereby enabling a larger number of vanes to be used in a single fanwheel.

Another object is to provide such a fanwheel which is more compact, and provides more energy absorbing capacity than conventional fanwheels.

In summary, it is a combined object of this invention to provide an exercising machine with an air vane type fanwheel which is more compact than conventional fanwheels and provides substantially greater air resistance by a combination of the following three factors: (1) the individual vane blades are specially shaped to provide a drag coefficient substantially greater than that for conventional flat plate vane blades; (2) the individual blades can be placed closer together because drafting is substantially eliminated, and therefore more of them can be provided in a single fanwheel, to multiply the drag of a single blade many times; and (3) the combined surface areas, front and back, of each vane blade are increased over those of a conventional flat plate vane blade allowing it to move a larger volume of air than if it were flat.

BRIEF DESCRIPTION OF THE DRAWINGS

Other objects and advantages will become apparent from the attached drawings in which.

DETAILED DESCRIPTION OF THE PREFERRED EMBODIMENTS

Figure 1:
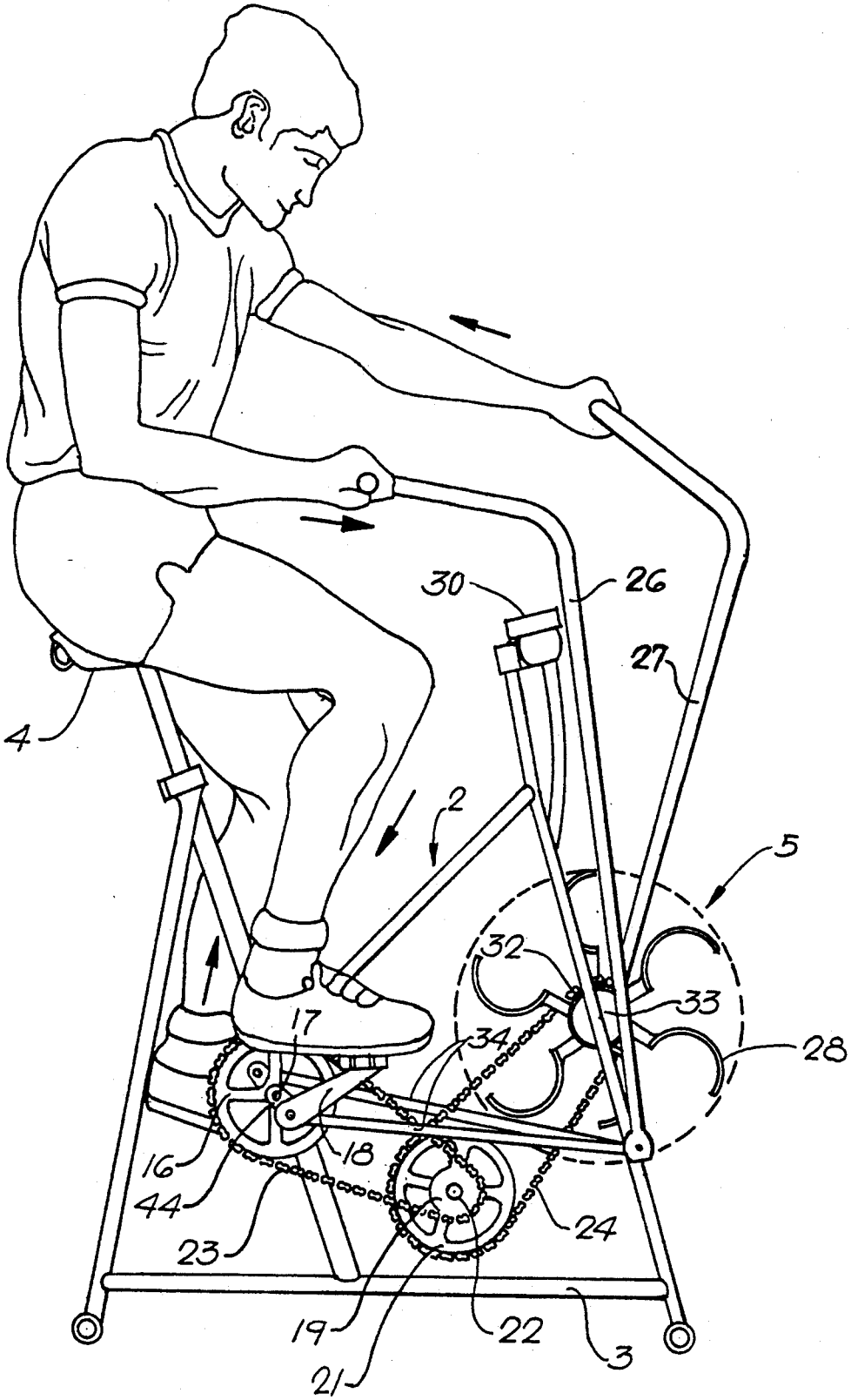
FIG. 1 is a side elevational view of a cycle exerciser incorporating an energy absorbing fanwheel illustrating a preferred form of the present invention.

For purposes of illustration but not by way of limitation, an anti-drafting, energy-absorbing fanwheel 5 is shown as the energy absorbing element in a cycle exerciser 2 shown in FIG. 1. It would be equally advantageous in many other types of exercising equipment including rowing machines, cross country ski machines, treadmills, stepping and stair climbing machines, and swimming machines.

A cycle exerciser similar to the one shown in FIG. 1, without the improved fanwheel, is shown and described in the above-mentioned prior art U.S. Pat. No. 4,188,030 to which reference may be had for details. Briefly, the exerciser 2 has a base section 3 supporting the exerciser on a floor or other surface. A seat 4 is provided at the rear end. A fanwheel 5 is driven from main drive shaft 17 through a primary speed-increasing belt 23 and a secondary speed increasing belt 24. More particularly, a large sheave 16 is mounted on drive shaft 17 and drives a smaller sheave 19 through belt 23. This rotates countershaft 22 which carries a relatively large secondary sheave 21 at the opposite end and drives a smaller fanwheel sheave 25 (FIG. 3) at a further increased speed through belt 24. Typically, belts 23 and 24 may each provide a three-times speedup, totaling nine times from main drive shaft 17 to the fanwheel sheave 25.

There are three ways of powering the main input shaft 17 to drive the fanwheel: first, through pedals 18 for lower body exercise; second, through oscillateable handle bars 26, 27, drive bars 34 and crank arm 44 for upper body exercise; and third, through both pedals and handlebars simultaneously for full upper and lower body exercise.

Resistance to fanwheel rotation is achieved by air vanes 28 which are specially shaped and oriented in accordance with the invention and will be described in detail. A direct reading work output meter 30 is commonly employed in such exercisers and the ergonometric effect is displayed as power absorbed by the fanwheel in watts, foot pounds per minute, gram calories per minute, horsepower or other suitable readout units. For further details, the ergonometric effect of air vane type energy absorbers, and calibration for accurate measurement of work output by the user, is described in Australian Patent No. 462,920.

Figure 3:
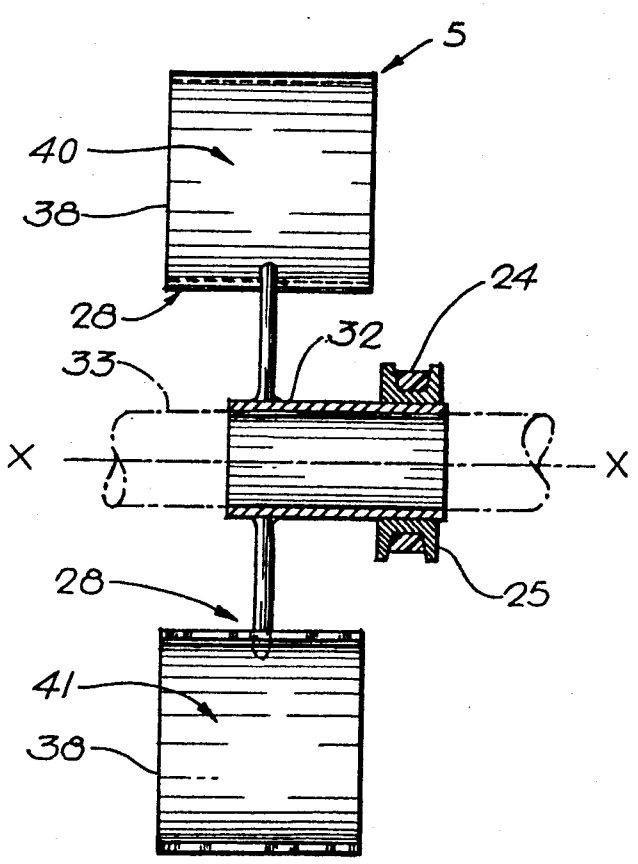
FIG. 3 is a cross-sectional view of FIG. 2 taken along line 3—3.
Figure 2:
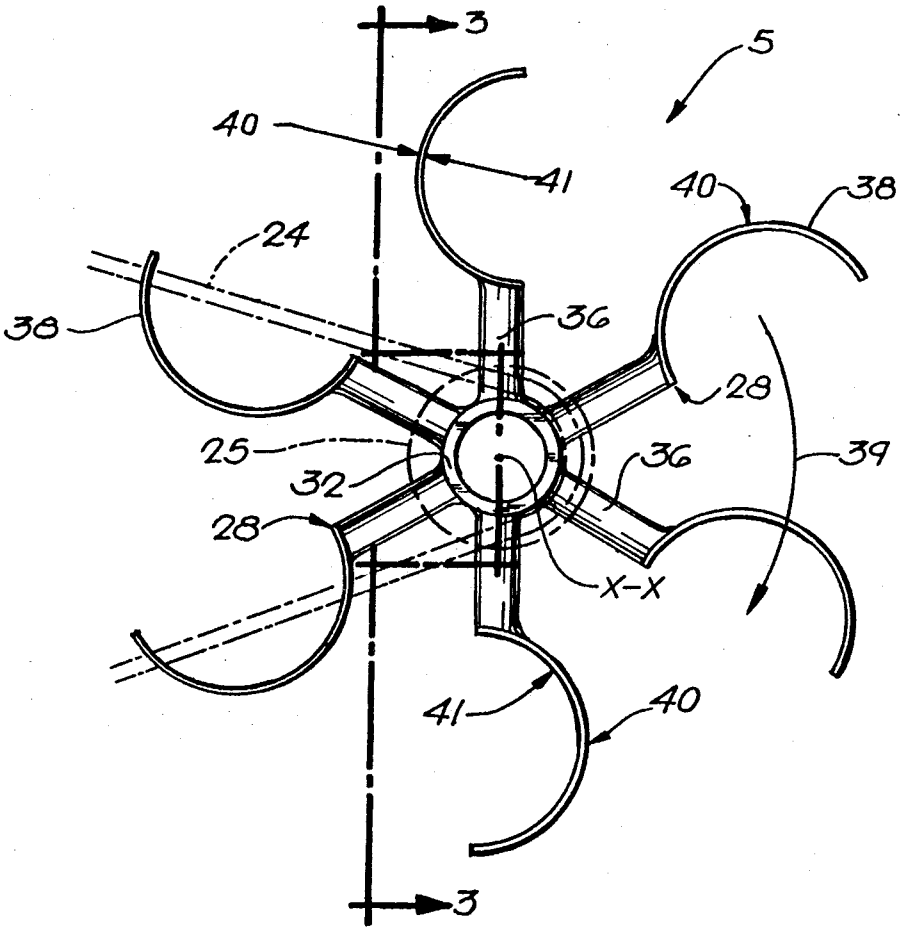
FIG. 2 is an enlarged side elevational view of the energy absorbing fanwheel illustrated in FIG. 1.
Figure 4:
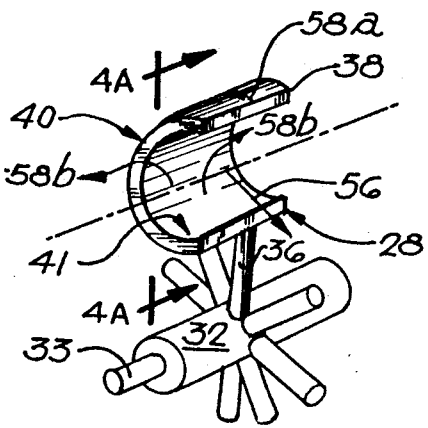
FIG. 4 is a fragmentary perspective view of FIG. 2.
Figure 4A:
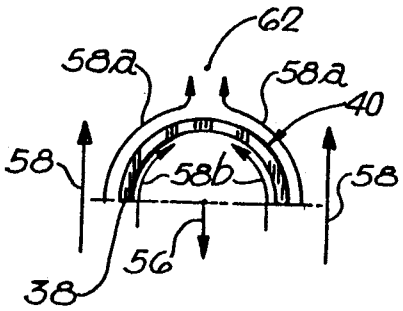
FIG. 4A is a fragmentary view of FIG. 4 taken in the direction of arrows 4A—4A.

Referring now to FIGS. 2, 3 and 4, the fanwheel 5 includes a hub 32 rotatable about a shaft 33 on a central axis X—X. There is a plurality (in this case, six) of air vanes 28, each comprising a radial spoke 36 and a concavo/convex, semi-cylindrical blade 38 movable in the direction of the arrow 39 about axis X—X. (FIGS. 2 and 3).

An important feature of the embodiment shown in FIGS. 1-4 is that the convex, streamlined trailing surfaces 40 of the blades are on the trailing side, and the concave surfaces 41 are on the leading side. This eliminates the stagnant, partial-vacuum, wake region which occurs between conventional flat blades as shown in FIG. 8, and guides the air flow around the convex trailing surfaces, enabling relatively high pressure air streams to impinge on successive blades as shown in FIG. 9.

Figure 8:
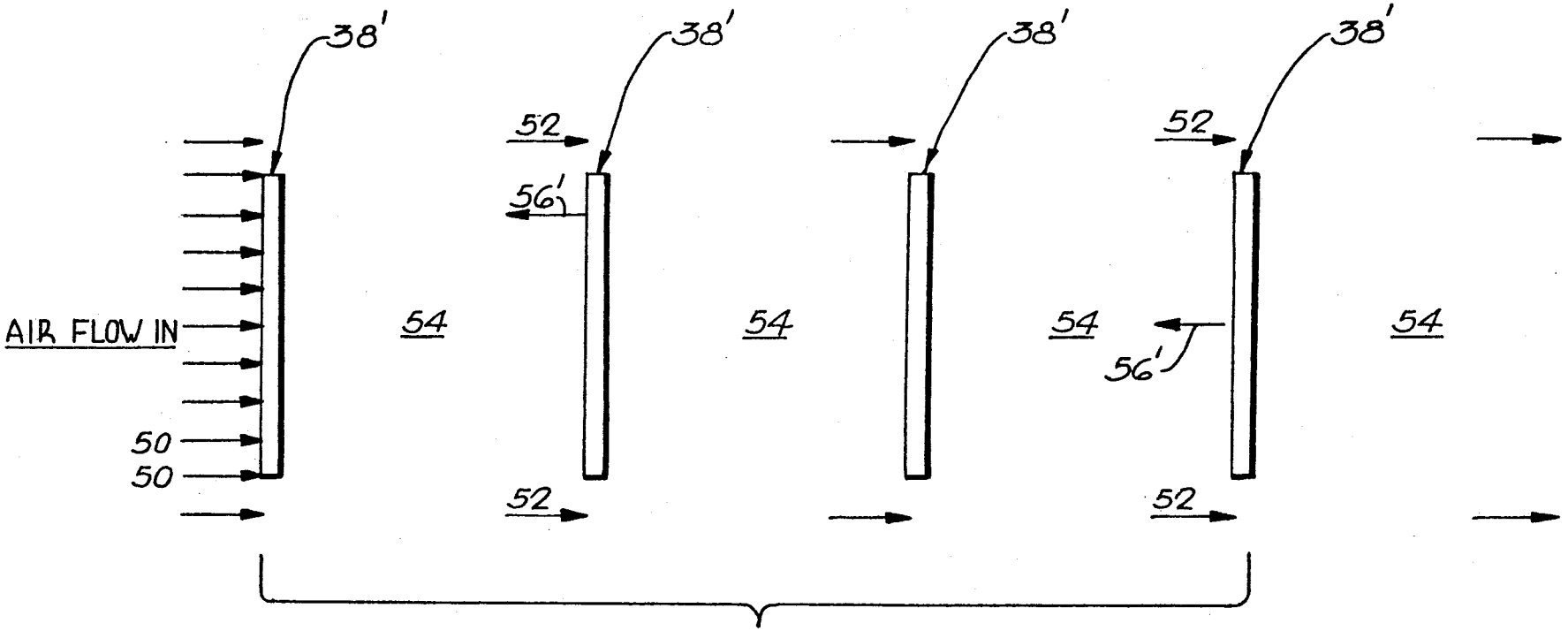
FIG. 8 (PRIOR ART)
FIG. 8 is a schematic view of prior art fanwheels showing a series of flat blades in drafting relation with one another.

FIG. 8 illustrates a plurality of flat plates 38', moving to the left in the direction of arrows 56'. (Comparable air flow conditions would occur if the blades were stationary and air flowed to the right, in the direction of arrows 50 and 52). The result would be a long stagnant wake region 54 produced behind each moving plate. This is a real disadvantage because the region 54 is a stagnant, partial vacuum area between successive blades. When any plate 38' creates such a partial vacuum behind it, this minimizes the air that can be moved by the following blade. This minimizes the air to be moved by that following blade and hence very little air resistance can be attributed to it. Since there are many wakes in line, behind the successive blades 38', there is a much reduced air flow into and out of the fanwheel, and small air resistance particularly at low speeds. This condition is known as "drafting" and may be experienced on a larger scale, on the highway, for example, where a bicycle or automobile tailgates a truck at high speed, riding in the wake produced by the truck.

Figure 9:
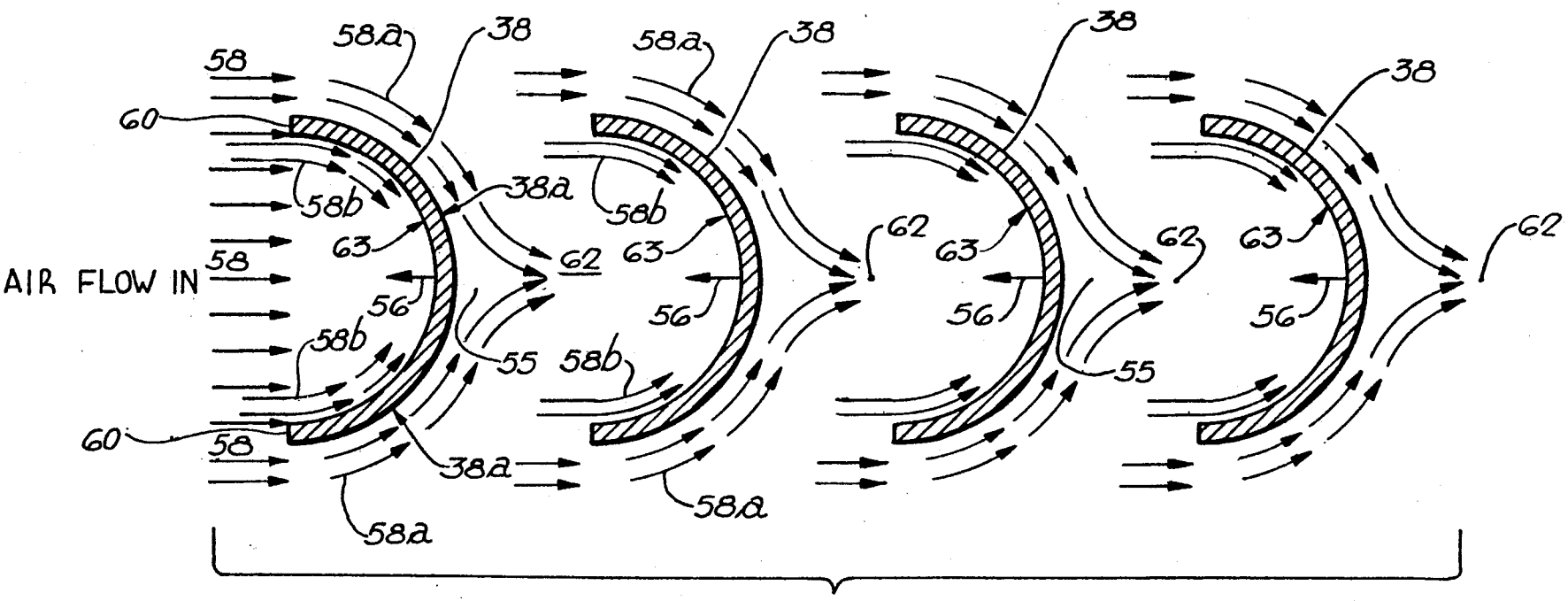
FIG. 9 is a schematic view of a fanwheel according to the present invention, showing a series of improved blades spaced apart identically as the prior art blades shown in FIG. 8, but in non-drafting relation with one another.

By contrast, FIG. 9 shows how the concavo/convex semi-cylindrical blades 38 of the present invention reduce the size and length of the wake to the extent that the stagnant air region 55 behind each blade 38 is virtually eliminated. In FIG. 9, the blades 38 move to the left, in the direction of arrows 56. Arrows 58 indicate the motion of the main ambient air relative to the blades. The leading edges 60 of the blades part the air into two streams, 58*a* and 58*b*. Streams 58*a* cling to the convex, streamlined rear side surfaces 38*a*, 38*a* and follow them around to the rear center of each blade where they combine and generate a dense, high pressure zone at 62 ahead of the leading concave surfaces 63 of the following blades, minimizing any stagnant wake region 55. Air in the relatively high pressure regions 62 is more dense than the air in the stagnant regions 54 in FIG. 8, and therefore generates more resistance to turning the fanwheel.

Air streams 58*b* are caught by the cup-like forward surfaces 63 as shown in FIG. 9 and spill out at the ends of the blades 38. This further increases resistance to turning the fanwheels.

The skin friction drag on these areas of both the leading and trailing surfaces contribute to this increased drag coefficient and is an important part of the present invention. In addition, the scooping effect of the leading concave surfaces 63 moves a larger volume of air than if they were flat. Inasmuch as it takes more power to move more air, the leading concave surfaces contribute further to the drag coefficient.

Figure 5:
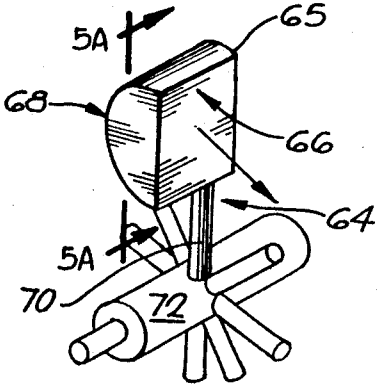
FIG. 5 is a view similar to FIG. 4 of an alternate form of the invention.
Figure 5A:
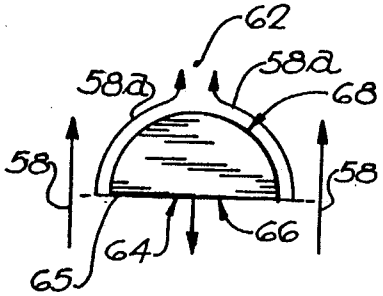
FIG. 5A is a fragmentary view of FIG. 5 taken in the direction of arrows 5A—5A.

FIGS. 5 and 5A show an alternate form of vane 64. Each comprises a plano/convex blade 65 having a flat, planar leading surface 66 and a convex semi-cylindrical trailing surface 68. Each is mounted on a spoke 70 and a hub 72.

Figure 6:
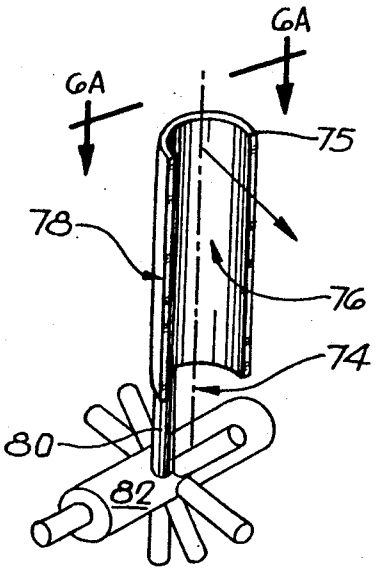
FIG. 6 is a view similar to FIG. 4 of a further alternate form of the invention.
Figure 6A:
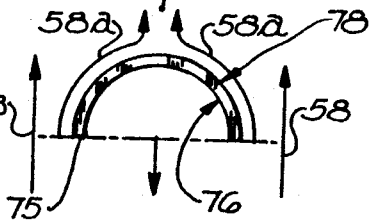
FIG. 6A is a fragmentary view of FIG. 6 taken in the direction of arrows 6A—6A.

FIGS. 6 and 6A show another alternate form of vane 74. Each comprises a concavo-convex semi-cylindrical blade 75 having a concave semi-cylindrical leading surface 76 and a convex semi-cylindrical trailing surface 78. It is mounted on a spoke 80 and a hub 82.

Blades 38 and 75 are both semi-cylindrical, but are oriented 90° apart, the axis of blade 38 being parallel to the hub and the axis of blade 75 being at right angles to the hub.

Figure 7:
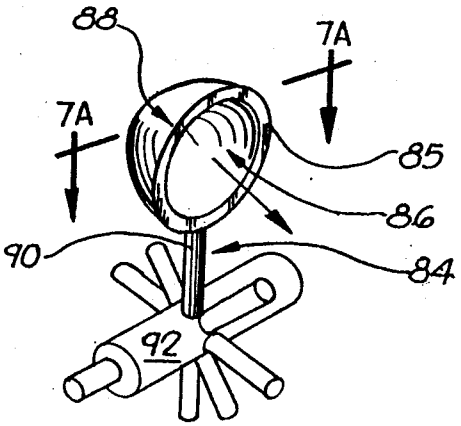
FIG. 7 is a view similar to FIG. 4 of a still further alternate form of the invention.
Figure 7A:
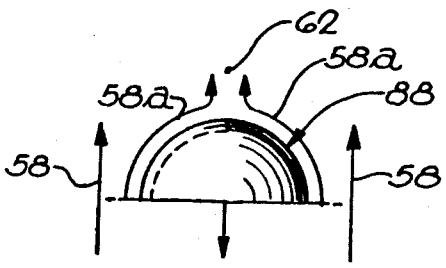
FIG. 7A is a fragmentary view of FIG. 7 taken in the direction of arrows 7A—7A.

FIGS. 7 and 7A show still another alternate form of vane 84. Each comprises a concavo-convex semi-spherical blade 85 having a concave semi-spherical leading surface 86 and a convex semi-spherical trailing surface 88. It is mounted on a spoke 90 and a hub 92.

One important feature of the invention which is common to all the embodiments disclosed is that the trailing surfaces 40, 68, 78 and 88 are convex and streamlined. These provide a common beneficial effect shown side by side for comparison in FIGS. 4A, 5A, 6A and 7A. In those figures, air streams 58*a* and 58*b* cling to the convex, streamlined rear side surfaces and generate high pressure zones comparable to those designated 62 in FIG. 9.

The enhanced energy absorbing ability of the present invention can be demonstrated mathematically using drag coefficients $C_D$ which are available for different geometric entities from tables in fluid dynamics textbooks. One such table is on page 460 of "Introduction to Fluid Mechanics" by Robert W. Fox and Allen T. McDonald, Third Edition, 1985, published by Wiley.

One very important factor in air resistance technology is the shape of the object generating the air resistance. This is important because it governs the drag coefficient $C_D$ which determines the drag force parallel to the direction of motion, on an object moving in a liquid or gas fluid. In exercising machines having a vane type energy absorber, it is of course desirable to use a blade shape with as high a drag coefficient as possible.

Figure 11:
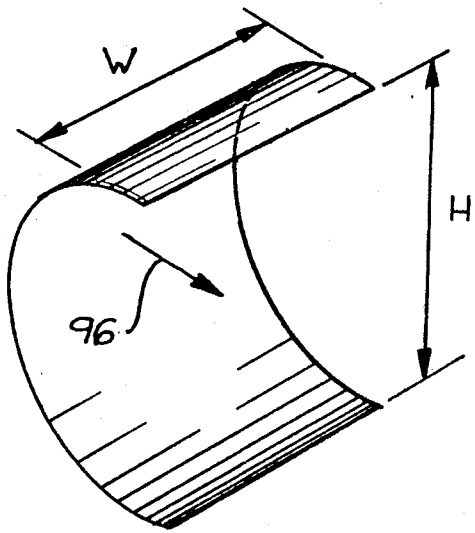
FIGS. 10 and 11 are schematic views comparing two fanwheel blades having identical projected areas, FIG. 10 representing the conventional flat blade illustrated in FIG. 8, and FIG. 11 representing the improved semi-cylindrical concavo/convex blade illustrated in FIG. 9.
Figure 10:
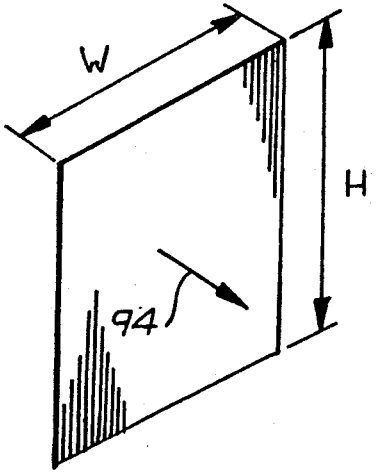
FIG. 10 (PRIOR ART)

It can be shown by means of FIGS. 10 and 11 that two objects having the same projected frontal area can have very different drag coefficients. For example, FIGS. 10 and 11 show blades which, moving in the direction of arrows 94 and 96, have exactly the same projected frontal area, $H=4.25'' \times W=3.75''=15.94$ square inches. But, from "Introduction to Fluid Mechanics" referred to above, $C_D$ for the flat plate shown in FIG. 10 is 1.2 and for the semi-cylindrical section with convex trailing surface and concave leading surface shown in FIG. 11 is 2.3, almost twice as great!

The increased drag coefficient for FIG. 11 is due in part to the concavo/convex shape. Because they are semi-cylindrical, the leading and trailing surface areas are 57% greater than comparable surface areas on the shorter, flat plates shown in FIG. 10. This increases the skin friction drag on both the leading and trailing surface areas. Skin friction drag is created by the tendency of an air stream to cling to the curved surfaces as shown and described above in connection with FIG. 9.

The following mathematical analysis taken with FIGS. 12–15, clearly demonstrates how a fanwheel according to the present invention provides more resistance to turning, and therefore is more effective as an energy absorber. It is also more compact than fanwheels using conventional, flat blade air vanes.

The fanwheel 5 illustrating the present invention and previously described in connection with FIGS. 2 and 3, is shown schematically in FIG. 12. As illustrated, it has six vanes 28 evenly circumferentially spaced about a hub 32, each vane comprising a blade 38 and a spoke 36 both shown enlarged in FIG. 13. The blade 38 is semi-cylindrical, having a semi-circumference $C=6.67''$ with a radius of curvature $r=2.125''$. The vane has a major radius $R_1=5.52''$ between the central axis X—X of the hub 32 and the middle of blade 38.

Figure 12:
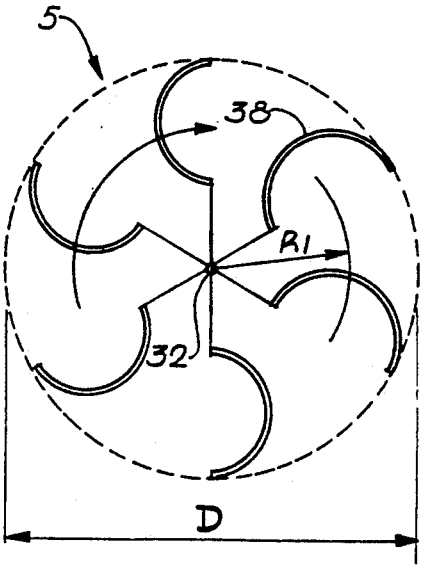
FIGS. 12 and 14 are schematic views comparing two fanwheels using exactly the same size vane blades, FIG. 12 showing rectangular plate blades curved to semi-cylindrical contours according to the present invention, and FIG. 14 showing the same rectangular plate blades, flat, in accordance with the prior art.
Figure 14:
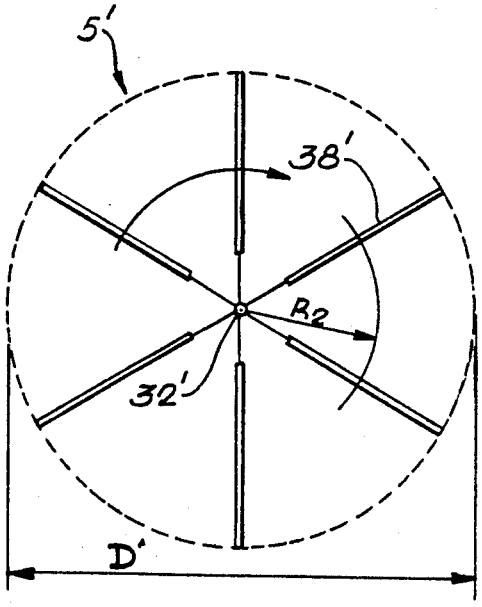
FIG. 14 (PRIOR ART)

The fanwheel 5′ shown in FIG. 14 illustrates the prior art in direct comparison with FIG. 12. For purposes of comparison, fanwheels 5 and 5′ are the same except the flat, prior art blades 38′ are straight and the same-size blades 38 in FIG. 12 are semi-cylindrical. One of the six vanes 28′, comprising a blade 38′ and a spoke 36′ is shown enlarged in FIG. 15. The blade 38′ is rectangular, having a radial length $C'=6.67''$, identical to the length of curved blade 38 if it were straightened out. Vane 28′ has a major radius $R_2=5.52''$ between the central axis X′—X′ of the hub 32′ and the middle of blade 38′.

To further minimize the variables between FIGS. 12/13 and FIGS. 14/15, the widths are the same, i.e., $W=W'=3.75''$.

Using the parameters specified above for FIGS. 12–15, and assuming the same speed 650 RPM, the same air at the same temperature and the same barometric pressure, the energy-absorbing capabilities of the improved fanwheel 5 and the prior art fanwheel 5′ can be directly compared by means of the following formula.

$$P=\left(\frac{C_D}{2}\right)\left[\left(\frac{M}{386.7}\right)\left(\frac{529.7}{T_X}\right)\left(\frac{B_X}{29.92}\right)\right]\left[(\mathrm{RPM})\left(\frac{\pi}{30}\right)(R)\right]^3 A \quad (1)$$

where:

P=power absorbed in watts, by a single vane

M=molecular weight of air, assumed to be 30

$T_x$=air temperature, Rankine scale, assumed to be 529.7.

Bx=barometric pressure in inches of mercury, assumed to be 29.92.

R=major radius in feet. This is $R_1$=5.52"=0.46 ft for FIGS. 12 and 13, and $R_2$=5.52"=0.46 ft for FIGS. 14 and 15).

A=frontal or projected area in square feet (For FIGS. 12/13, this is $$\frac{3.75 \times 4.25}{144} = 0.11 \text{ ft}^2)$$

(For FIGS. 14/15, this is $$\frac{3.75 \times 6.67}{144} = 0.174 \text{ ft}^2)$$

RPM=(Assumed to be 650)

By substituting M=30, $T_x$=529.7, $B_x$=29.92, RPM=650 and R=0.46 ft in Equation "(1)", this simplifies to $$P=1191\ A\ C_D$$

In Table 9.2 on page 460 of the above-cited publication "Introduction to Fluid Mechanics", the drag coefficients for the blades 5 and 5' shown in FIGS. 12/13 and 14/15 respectively are given. The semi-cylindrical blade 5 of the present invention is listed as "C-section open side facing flow" for which the drag coefficient $C_D$ is given as 2.3. In FIG. 9.10 of that publication, $C_D$ for the flat plate blade 5' is 1.2.

Now, substituting the values of A and $C_D$ in Equation "(2)", the comparative power absorbing capacities $P_5$ and $P_{5'}$ of the present and prior art fanwheels, respectively, per vane, are as follows:

For one prior art vane 28' (FIGS. 14 and 15):

$$P_{5'}=(1191)\ (0.174)\ (1.2)=249 \text{ watts}$$

For one improved vane 28 (FIGS. 12 and 13):

$$P_5=(1191)\ (2.3)\ (0.11)=301 \text{ watts}$$

Figure 13:
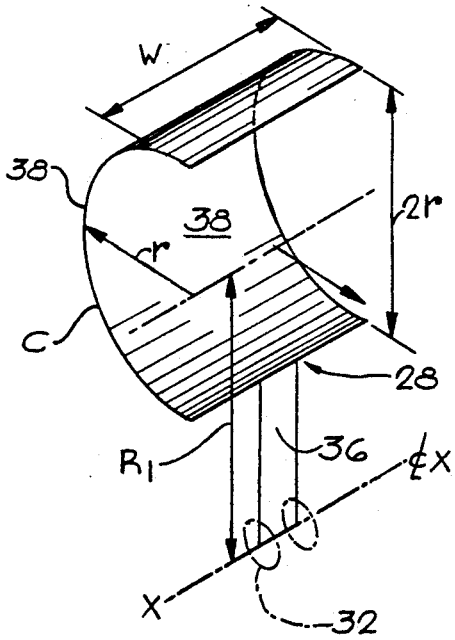
FIGS. 13 and 15 are enlarged, perspective views of the present improved blade, and a prior art blade, shown respectively in FIGS. 12 and 14.
Figure 15:
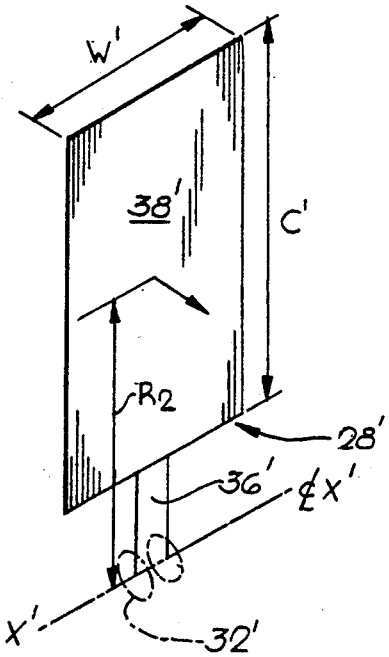
FIG. 15 (PRIOR ART)

Thus, by merely changing the shape of the flat, prior art blades 38' shown in FIGS. 14 and 15, to the trailing convex configurations shown in FIGS. 12 and 13, the energy absorbing capability of the fanwheel can be increased more than 20%!

Another advantage of the fanwheel of the present invention shown in FIG. 12 is that it is more compact than the prior art fanwheel shown in FIG. 14. The overall diameter D of the improved fanwheel shown in FIG. 12 is only 15.3" as compared with the overall diameter D' of 17.71" for the prior art fanwheel shown in FIG. 14. This is a reduction in volume of 16%!

A still further advantage of the present invention is that the blades 38 with convex rear surfaces can function at maximum effectiveness when spaced much closer together than is possible with the prior art flat vanes. For example, the flat blades shown in FIGS. 8 and 14 will generate a substantial stagnant wake region behind each blade causing each blade to "draft" behind the respective leading blade next ahead. Because of this, the flat blades 38' (FIGS. 14/15) must be spaced far enough apart to minimize the effects of the stagnant wake regions 54.

By contrast, as shown in FIG. 9, there is a relatively insignificant stagnant wake region 55 behind each blade 38 in the present invention because of the rearwardly convex shape at the trailing sides of the blades. In FIG. 9 the arrows 56 indicate right to left movement of the blades 38 and arrows 58*a* and 58*b* indicate left to right movements of air streams relative to the blades. As a result, the veritable absence of a wake region between blades in the present invention, enables them to be fully effective when spaced much closer together than the flat, prior art blades.

In Summary,

The present invention has several substantial advantages over the prior art:

(1) For a given power absorption, each fanwheel is more compact than a corresponding prior art fanwheel;

(2) Each fanwheel absorbs more power than a corresponding prior art fanwheel; and (3) Each fanwheel can have more blades without developing unwanted drafting effects between blades, thereby further increasing the energy absorbing capacity simply by using more blades per fanwheel.

The embodiments described and shown to illustrate the present invention have been necessarily specific for purposes of illustration. Alterations, extensions and modifications would be apparent to those skilled in the art. The aim of the appended claims, therefore, is to cover all variations included within the spirit and scope of the invention.

The embodiments of the invention in which an exclusive property or privilege is claimed are defined as follows:

1. In an exercising machine, and in combination;

a frame;

an anti-drafting energy absorbing fanwheel rotatably mounted on the frame and comprising a hub having an axis with a plurality of air vanes in a central plane of the fanwheel and being movable in an orbit around the axis of the hub;

power input means supported on said frame effective when operated to rotate said fanwheel in one direction;

each air vane comprising a blade having a leading surface and a streamlined trailing surface when rotating in said one direction;

each said streamlined trailing surface having opposite, rearwardly converging side surface portions effective to direct opposite converging air streams along said side surface portions and merge them into a relatively higher pressure stream in said central plane behind said streamlined trailing surface; and said vanes being circumferentially spaced apart to substantially eliminate drafting between vanes and enable said higher pressure stream behind each trailing surface to impinge on the leading face of the respective immediately following vane in said central plane.

2. In an exercising machine, the combination of claim 1 in which:

the leading surface of each blade is hollow.

3. In an exercising machine, the combination of claim 1 in which:

each blade is a curved member with convex and concave sides on the trailing and leading sides respectively of the blade.

4. In an exercising machine, the combination of claim 3 in which:

each curved member is substantially partially cylindric and has an axis extending in spaced generally parallel relationship to the axis of the hub.

5. In an exercising machine, the combination of claim 3 in which:

each curved member is substantially partially cylindric and has an axis extending in generally radial relationship to the axis of the hub.

6. In an exercising machine, the combination of claim 3 in which:

each curved member is substantially semi-cylindrical in shape with an axis extending substantially parallel to the axis of the hub.

7. In an exercising machine, the combination of claim 3 in which:

each curved member is substantially semi-cylindrical in shape with an axis extending in generally radial relationship to the axis of the hub.

8. In an exercising machine, the combination of claim 1 in which:

each blade comprises a cup-like with a convex side on the trailing surface and a concave side on the leading surface.

9. In an exercising machine, the combination of claim 8 in which:

each vane is a substantially hemispherical hollow member.

* * * * *

UNITED STATES PATENT AND TRADEMARK OFFICE

CERTIFICATE OF CORRECTION

PATENT NO. : 5,211,613

DATED : May 18, 1993

INVENTOR(S) : Robert C. Friesl

It is certified that error appears in the above-indentified patent and that said Letters Patent is hereby corrected as shown below:

Cols. 7 and 8, line 1, in front of equation, insert -- (1) --;

Col. 7, line 32, in front of equation, insert -- (2) --;

Col. 10, line 16, after "cup-like" insert -- member --.

Signed and Sealed this

Twenty-ninth Day of March, 1994

Bruce Lehman

*Attest:*

BRUCE LEHMAN

*Attesting Officer*

*Commissioner of Patents and Trademarks*